US005284278A

United States Patent [19]

Waltenspühl

[11] Patent Number: 5,284,278

[45] Date of Patent: Feb. 8, 1994

[54] SHUT OFF PLATE ASSEMBLY FOR SLIDE GATE

[75] Inventor: Rolf Waltenspühl, Hünenberg, Switzerland

[73] Assignee: Stopinc Aktiengesellschaft, Baar, Switzerland

[21] Appl. No.: 973,009

[22] Filed: Nov. 5, 1992

[30] Foreign Application Priority Data

Nov. 19, 1991 [CH] Switzerland ..... 03371/91-9

[51] Int. Cl.[5] ..... B22D 41/42

[52] U.S. Cl. ..... 222/603; 222/600

[58] Field of Search ..... 266/217, 236; 222/600, 222/603

[56] References Cited

U.S. PATENT DOCUMENTS 4,415,103 11/1983 Shapland et al. ..... 222/603

FOREIGN PATENT DOCUMENTS 1938117 12/1975 Fed. Rep. of Germany .

0165266 7/1986 Japan ..... 222/600

*Primary Examiner*—Scott Kastler

*Attorney, Agent, or Firm*—Wenderoth, Lind & Ponack

[57] ABSTRACT

A shut off plate assembly for use in a slide gate includes a refractory plate having on respective opposite sides thereof a planar surface defining a slide plane of the slide gate and a recess. A discharge opening extends through the refractory plate and at opposite ends thereof opens onto the planar surface and into the recess. The recess thus expands outwardly the discharge opening. An insert is formed of a highly refractory material and has therethrough a discharge opening. The insert is positioned in the recess with the discharge openings of the plate member and the insert in alignment and defining a discharge passage through the assembly. The insert and the plate member have respective confronting surfaces that define a joint that opens into the discharge passage. Thus, a gas may be injected through the joint into the discharge passage.

27 Claims, 1 Drawing Sheet

SHUT OFF PLATE ASSEMBLY FOR SLIDE GATE

BACKGROUND OF THE INVENTION

The present invention relates to a shut off plate assembly for use in a sliding closure unit or a slide gate mounted on a vessel containing molten metal for controlling the discharge of the molten metal from such vessel. Particularly, the present invention relates to such a shut off plate assembly of the type including a refractory plate having therethrough a flow or discharge opening, and an insert surrounding the discharge opening and to enable a gas to be injected into the discharge opening.

German DE-PS 19 38 117 discloses a slide gate including a stationary shut off plate assembly of the above type and including an insert in the form of a gas permeable annular sleeve surrounding the discharge or flow opening. Thus, when the slide gate is closed, gas can be injected through the gas permeable annular sleeve into the discharge opening, thereby preventing molten steel from solidifying within a discharge spout of the metallurgical vessel. Additionally, gas can be injected through the gas permeable annular sleeve when the slide gate is in an opened position, for example during a pouring or discharge operation, for the purpose of preventing molten steel from clogging the discharge opening and also for the purpose of forming a seal to prevent the molten steel that is being discharged from absorbing exterior oxygen or air.

However, in this known arrangement, the gas permeable annular sleeve is formed of a relatively porous refractory material and as such has a relatively low resistance to abrasion and erosion that occurs during molten metal discharge. The refractory plate on the other hand normally is formed of a highly refractory material, for example usually compressed or more dense, that has a greater resistance to abrasion and erosion. As a result, material of the plate assembly in the region of the annular sleeve very rapidly can be washed out or eroded away. As a consequence, the entire plate assembly becomes useless and must be taken out of service. This particularly is disadvantageous when the plate assembly is a bottom or stationary plate assembly.

SUMMARY OF THE INVENTION

With the above discussion in mind, it is an object of the present invention to provide an improved shut off plate assembly of the above described type, but whereby it is possible to avoid the above and other prior art disadvantages.

It is a further object of the present invention to provide such a plate assembly by which it is possible to achieve very efficient and controlled gas injection.

It is a still further object of the present invention to provide such a plate assembly having an increased useful life and which is capable of production at a reduced cost.

The above objects are achieved in accordance with the present invention by the provision of a shut off plate assembly including a refractory plate having on each of respective opposite sides thereof a planar surface to define a slide plane of the slide gate and a recess. A discharge opening extends through the refractory plate and has opposite ends respectively opening onto the planar surface and into the recess, with the recess expanding outwardly the respective end of the discharge opening. An insert formed of a highly refractory material and having therethrough a discharge opening is positioned in the recess in the plate member with the discharge openings of the plate member and the insert in alignment, thus defining a discharge passage through the plate assembly. The insert and the plate member in the area of the recess thereof have respective confronting surfaces that define a joint that opens into the discharge passage, thereby enabling gas to be introduced, for example injected, into the discharge passage.

By the provision of a shut off plate assembly constructed in the above manner, it is possible to achieve a very accurately targeted and efficient injection of gas into the discharge passage. Furthermore, the highly refractory insert can be embedded in the plate member by a very simple production technique. Furthermore, the useful life of the overall assembly will be comparable to that of the highly refractory plate member, since the assembly does not include a highly porous sleeve insert, but rather the material of the insert is non-porous, i.e. impermeable to the gas.

The highly refractory insert is embedded in the plate member in a manner such that there is defined therebetween a gap that forms the joint. The insert is mortared laterally outwardly thereof to the plate member. Also, the insert may be mortared laterally outwardly to a shell or jacket that surrounds or envelopes the plate member.

In accordance with one arrangement of the present invention, the gap between abutting surfaces of the insert and the plate member that defines the joint may be as a result of unevenness, i.e. surface irregularities, between such mutually abutting surfaces. However, it also is possible to define the joint by positioning between confronting surfaces of the insert and the plate member a thin layer of readily combustible material, for example paper.

In a preferred embodiment according to the present invention, an annular gas chamber is defined to surround the joint and to communicate therewith. Such annular chamber can be defined by surfaces of the insert and of the plate member defining the recess.

In accordance with a further embodiment of the present invention, the joint may incline slightly in a direction toward the planar surface of the plate member. This inclination can be at an angle of, for example, 5° to 30°. In this manner, it is possible to provide that the gas being injected into the discharge passage is accurately directed, and specifically such gas injection may be achieved in a manner to reach a closed position of a sliding plate employed in conjunction with the plate assembly of the invention to form the slide gate. Thus, the injected flow of gas will ensure that molten material in the region of such slidable plate is recirculated and thereby prevented from solidifying.

BRIEF DESCRIPTION OF THE DRAWINGS

Other objects, features and advantages of the present invention will be apparent from the following description, taken with the accompanying drawings, wherein.

DETAILED DESCRIPTION OF THE INVENTION

Figure 1:
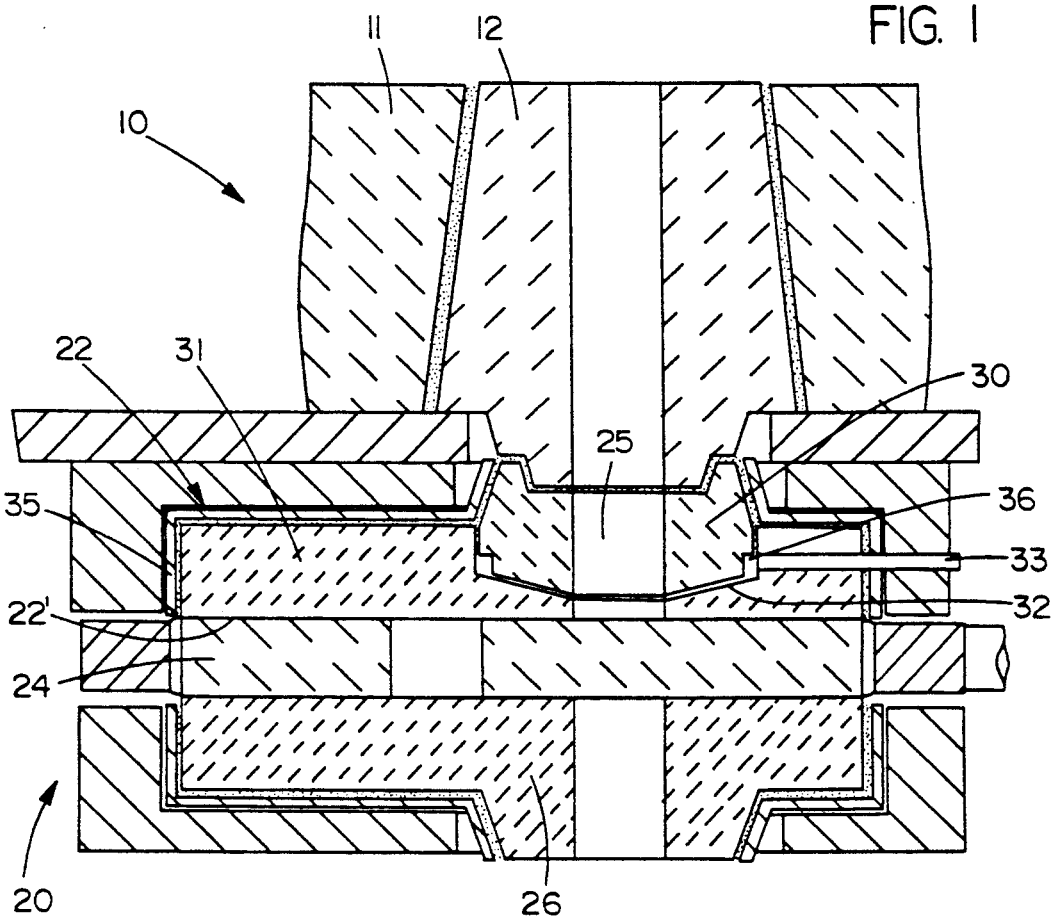
FIG. 1 is a schematic longitudinal cross sectional view through a slide gate mounted on a metallurgical vessel and including a shut off plate assembly in accordance with one embodiment of the present invention.

Shown schematically in FIG. 1 is a portion of a metallurgical vessel 10 adapted to contain molten metal, for example molten steel. The vessel is intended to be of conventional structure and including, for example, an outer metal shell or jacket 13 having therein a refractory lining 11. Vessel 10 may be, for example, a tundish from which molten steel is to flow in a controlled manner into a continuous casting mold. A refractory sleeve 12 is embedded within refractory lining 11. A sliding closure unit or slide gate 20 is mounted in a conventional manner exteriorly of vessel 10. The slide gate 20 is intended to be conventional, other than the unique and novel features in accordance with the present invention. The illustrated slide gate includes an upper stationary or bottom refractory shut off plate assembly 22, a lower stationary refractory shut off plate assembly 26, and a movable shut off plate assembly 24 slidable in opposite directions between assemblies 22, 26. The refractory plates of each of assemblies 22, 24 and 26 have therethrough respective flow or discharge passages. When movable plate 24 is in the closed position, as illustrated in FIG. 1, the discharge passage thereof is out of alignment with the discharge passages of stationary assemblies 22, 26. Movable assembly 24 is slidable, toward the right in the illustrated embodiment, to bring the discharge passage thereof into alignment with the discharge passages of assemblies 22, 24, thereby opening the slide gate. The structure and principle of operation of such a slide gate are well known and will not be further discussed herein. Upper plate assembly 22 is connected sealingly, for example by an illustrated so-called groove-tongue connection, to sleeve 12.

In accordance with the present invention, shut-off plate assembly 22 includes an outer, normally metal, shell or jacket 35. A refractory plate 31 is mortared into jacket 35. An insert 30 is mortared into refractory plate 31, and also to jacket 35. Plate member 31 has on one side thereof a planar sliding surface 22' defining a slide plane of the slide gate and against which slides an upper planar surface of the refractory plate of assembly 24.

In accordance with the present invention, plate member 31 has on a side thereof opposite the planar surface 22' a recess. A flow or discharge opening extends through plate member 31, and opposite ends of such opening open onto planar surface 22' and open into the recess. In accordance with the present invention, insert 30 is formed of a highly refractory material and has therethrough a discharge opening 25. Insert 30 is mortared within the recess in plate member 31 with the discharge opening 25 aligned with the discharge opening through the plate member 31, thus defining a discharge passage through the assembly 22.

The insert 30 and the plate member 31 have respective confronting surfaces that define therebetween a joint 32 that opens into the discharge passage. Formed outwardly of joint 32 is an annular gas chamber 36 formed between and by respective surfaces of plate member 31 and insert 30. To chamber 36 is connected a gas connection 33. Thus, a gas can be injected into the discharge passage through assembly 22 by being passed through connection 33 into annular chamber 36, and then through annular joint 32 into the discharge passage. The recess in which fits the insert 30 expands outwardly the discharge opening through plate member 31 to a size sufficient to receive insert 30. The portion of insert 30 above chamber 36 is mortared to a confronting surface of the recess in plate member 31.

The joint 32 is mortarless and is defined, in the embodiment of FIG. 1, by confronting surfaces of insert 30 and plate member 31 being in abutment, thereby forming a gap as a result of unevenness or surface irregularities of such abutting surfaces.

In the arrangement illustrated in FIG. 1, the joint 32 is inclined toward planar surface 22', for example at an angle of from 5° to 30°. Particularly, it is contemplated that the joint 32 illustrated in FIG. 1 may have a frustoconical configuration converging in a direction toward planar surface 22'. One preferred angle of inclination of joint 32 to surface 22' is 10°.

In the closed position of the slide gate illustrated in FIG. 1, for example prior to a molten metal discharge operation, a specified quantity of gas is distributed impulsively and constantly from gas connection 33 into annular gas chamber 36 and from there is injected through joint 32 into the discharge opening through assembly 22. Any molten metal located in the bottom portion of the discharge passage will be recirculated and prevented from solidifying over a prolonged period of time, for example up to several minutes. The downwardly inclined configuration of joint 32 also makes it possible to ensure that molten metal located directly over slide valve plate 24 is recirculated. In other words, the inclined orientation of joint 32 causes gas that is injected into the discharge passage to be directed to the bottom of such passage, i.e. into any molten metal directly above the surface of plate 24. This prevents solidification of such molten metal. It of course is to be understood that gas can be injected, for various purposes, through joint 32 even when the slide gate is in an open position.

Joint 32 is spaced above planar surface 22' by a distance selected in a manner such that joint 32 is above a wear zone of plate 31 that is subjected to the greatest stress during operation of the slide gate. That is, planar surface 22' of plate member 31 is worn by the greatest extent in the region of the discharge opening. Joint 32 is positioned sufficiently above surface 22' such that joint 32 will not open into an area of wear around the discharge passage, even during advanced use of the assembly. Optimally, this distance is at least 5 mm, but in certain specific applications such distance may need to be up to 20 mm. Such distance preferably is such that any molten metal immediately above the upper surface of plate 24 in the closed position of the slide gate can be recirculated and prevented from solidifying.

The highly refractory sleeve-shaped insert 30 is mortared into jacket 35 surrounding plate member 31, and as indicated above, insert 30 is mortared to plate member 31 in the area above gas chamber 36.

By the provision of a plate assembly of the above construction it is possible to achieve, by means of a simple production operation, the possibility of a highly accurately targeted or directed and efficient injection of gas. Furthermore, it is possible to ensure that the useful service life of the overall assembly 22 is increased, compared with known such assemblies.

Figure 2:
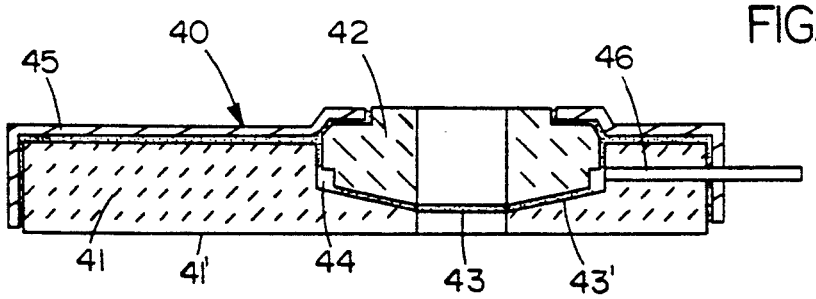
FIG. 2 is a similar view but of a shut off plate assembly only and in accordance with another embodiment of the present invention.

The shut off plate assembly 40 shown in FIG. 2 includes, similarly to the above embodiment, a refractory plate member 41 having a planar slide surface 41' and an opposite recess, an insert 42 of highly refractory material embedded in such recess, and a plate shell or jacket 45 surrounding plate member 41 and insert 42. In this embodiment however, the joint 43 is formed by the provision of a layer 43' of a highly combustible material positioned between confronting surfaces of insert 42 and plate member 41. An example of suitable easily combustible material is paper. Such spacing paper can have, as a general rule, a thickness ranging from approximately 0.1 to 0.5 mm. Such paper burns at least partially as soon as molten metal is passed into the discharge passage. This embodiment also has an annular gas chamber 44 enveloping joint 43 and to which is connected a gas connection 46. The joint 43 of this embodiment may be employed in any of the other embodiments of the present invention. FIG. 2 illustrates a further variation of this embodiment, wherein insert 42 projects only a slight distance above the top of plate member 41, with insert 42 being mortared into jacket 45 and also mortared to plate member 41 at an area above gas chamber 44. This embodiment of the present invention provides the same manner of operation and advantages of the embodiment discussed above with regard to FIG. 1.

Figure 3:
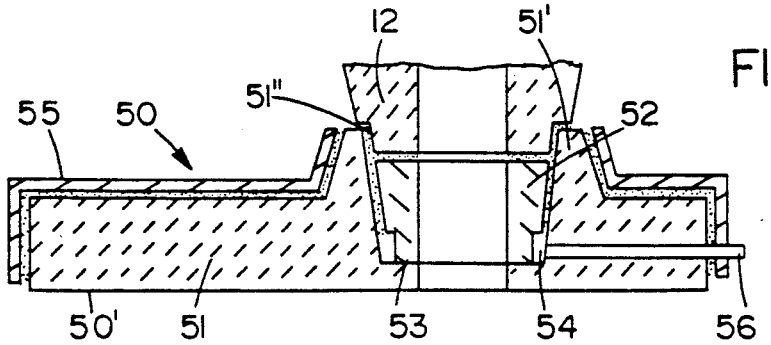
FIG. 3 is a similar view of a further embodiment of the present invention.

In the embodiment of FIG. 3, a shut off plate assembly 50 includes a refractory plate member 51 mortared into a surrounding plate shell or jacket 55. In this embodiment however, plate member 51 has an upwardly extending annular projection or shoulder 51' defining an upwardly and outwardly expanding discharge opening 51'' into which is inserted and mortared an insert 52 formed of a highly refractory material. Thus, annular projection 51' extends upwardly beyond the entire insert 52, and a lower surface of sleeve 12 extends into opening 51'' and abuts the top of insert 52, preferably with mortar therebetween. This arrangement provides an optimal seal between sleeve 12 and plate member 51.

FIG. 3 also illustrates a further modification of the present invention, wherein a joint 53 extends parallel to planar surface 50' of plate member 51. Joint 53 may be formed in any of the manners discussed above. An annular chamber 54 surrounding joint 53 has connected thereto a ga connection 56. Thus, gas injected into the discharge passage in the embodiment of FIG. 3 will be directed radially inwardly thereof. The form of the joint 53 illustrated in FIG. 3 may be employed in any of the other above discussed embodiments.

The particular material and the particular manner of production of the insert 30, 42, 52 in accordance with the present invention may be similar to or corresponding to those of the respective plate members. In other words, in accordance with the present invention, it is not necessary that the insert be of a highly gas permeable or porous refractory material that is subject to relatively rapid erosion and wear. Rather, the insert in accordance with the present invention may be formed to be highly wear and erosion resistant in a manner similar to that of the refractory plate member. This increases the useful service life of the insert, and therefore of the overall plate assembly. Thus, one skilled in the art readily would understand the types of materials and manners of production employable for the inserts of the invention. Normally, such material would include zirconia or magnesia, substantially compressed or poured high alumina. Such known materials have proven to be most advantageous, depending on the particular application involved, and enable the overall plate assembly to have a maximized service life.

Although the present invention has been described and illustrated with respect to preferred embodiments thereof, it is to be understood that various changes and modifications may be made to the specifically described and illustrated features without departing from the scope of the present invention.

I claim:

1. A shut off plate assembly for use in a slide gate for controlling the discharge of molten metal from a metallurgical vessel, said assembly comprising:

a refractory plate having on respective opposite sides thereof a planar surface to define a slide plane of the slide gate and a recess, and a discharge opening extending through said refractory plate and having opposite ends respectively opening onto said planar surface and into said recess, with said recess expanding outwardly the respective said end of said discharge opening;

a gas impermeable insert formed of a non-porous highly refractory material and having therethrough a discharge opening, said insert being positioned in said recess with said discharge openings of said plate member and said insert in alignment to define a discharge passage; and said insert and said plate member having respective confronting surfaces defining a joint opening into said discharge passage and forming means to introduce gas into said discharge passage.

2. An assembly as claimed in claim 1, wherein said joint comprises a gap formed between said confronting surfaces.

3. An assembly as claimed in claim 2, wherein said confronting surfaces are in abutment, and said gap is formed due to unevenness of the thus abutting said surfaces.

4. An assembly as claimed in claim 1, wherein said joint is formed by a layer of readily combustible material positioned between said confronting surfaces.

5. An assembly as claimed in claim 4, wherein said material is paper.

6. An assembly as claimed in claim 4, wherein said layer has a thickness of from 0.1 to 0.5 mm.

7. An assembly as claimed in claim 1, wherein said joint extends parallel to said planar surface.

8. An assembly as claimed in claim 1, wherein said joint is inclined toward said planar surface.

9. An assembly as claimed in claim 8, wherein said joint is inclined to said planar surface by an angle of from 5° to 30°.

10. An assembly as claimed in claim 1, wherein said joint has a frusto-conical configuration converging in a direction toward said planar surface.

11. An assembly as claimed in claim 10, wherein said joint extends at an angle of from 5° to 30° relative to said planar surface.

12. An assembly as claimed in claim 1, further comprising an annular chamber surrounding said joint and in communication therewith.

13. An assembly as claimed in claim 12, wherein said annular chamber is formed between said insert and said plate member.

14. An assembly as claimed in claim 13, wherein said annular chamber is defined by an outer groove formed in said insert and by surfaces of said plate member defining said recess therein.

15. An assembly as claimed in claim 12, further comprising a gas connection coupled to said annular chamber, thereby enabling gas to be supplied thereto and through said joint to said discharge passage.

16. An assembly as claimed in claim 1, wherein said insert is mortared into said recess in said plate member.

17. An assembly as claimed in claim further comprising a jacket surrounding said plate member.

18. An assembly as claimed in claim 17, wherein said insert is mortared to said plate member.

19. An assembly as claimed in claim 1, wherein said insert has at an end thereof opposite said plate member a projection/groove for connection to a sleeve of the vessel.

20. An assembly as claimed in claim 1, wherein said plate member has an integral annular projection extending beyond an outer end of said insert.

21. An assembly as claimed in claim 1, wherein said highly refractory material is the same as material of which said plate member is formed.

22. An assembly as claimed in claim 21, wherein said highly refractory material substantially comprises alumina, magnesia or zirconia.

23. An assembly as claimed in claim 1, wherein said joint is spaced from said planar surface by a distance of 5 to 20 mm.

24. An assembly as claimed in claim 18, wherein said insert is mortared to said jacket.

25. An assembly as claimed in claim 17, wherein said insert is mortared to said jacket.

26. An assembly as claimed in claim 1, wherein said joint is mortarless.

27. An assembly as claimed in claim 1, wherein said inert is spaced from said planar surface and said slide plane.

* * * * *